US007761948B2

(12) United States Patent
Irwin

(10) Patent No.: US 7,761,948 B2
(45) Date of Patent: Jul. 27, 2010

(54) WASTE LINE INSPECTION AND CLEAN-OUT TOOL

(76) Inventor: Lawrence F. Irwin, 640 Jessie St., San Fernando, CA (US) 91340-2233

( * ) Notice: Subject to any disclaimer, the term of this patent is extended or adjusted under 35 U.S.C. 154(b) by 526 days.

(21) Appl. No.: 11/890,961

(22) Filed: Aug. 7, 2007

(65) Prior Publication Data

US 2009/0038093 A1 Feb. 12, 2009

(51) Int. Cl.
*B08B 9/04* (2006.01)
*B08B 9/043* (2006.01)

(52) U.S. Cl. ..... 15/104.095; 15/104.33

(58) Field of Classification Search ..... 15/104.095, 15/104.31, 104.33

See application file for complete search history.

(56) References Cited

U.S. PATENT DOCUMENTS 5,193,242 A * 3/1993 Irwin ..... 15/104.33
5,457,288 A * 10/1995 Olsson ..... 174/117 R
5,862,561 A * 1/1999 Irwin ..... 15/104.33
5,996,159 A * 12/1999 Irwin ..... 15/104.33

* cited by examiner

*Primary Examiner*—Randall Chin

(57) ABSTRACT

A waste line clean-out apparatus in which a video camera is positioned proximate the outboard end of an elongated flexible coil spring assembly and is interconnected with a remotely located viewing monitor by means of various operating cables, including a fiber optic signal transmitting cable. The apparatus includes a pull cable that extends interiorly of the spring assembly for protecting the fiber optic signal transmitting cable and the various companion operating cables from undue stress during the waste line clean-out operation.

12 Claims, 5 Drawing Sheets

WASTE LINE INSPECTION AND CLEAN-OUT TOOL

BACKGROUND OF THE INVENTION

1. Field of the Invention

The present invention relates generally to plumbers' tools of the type used to remove and clean away obstructions formed in and blocking waste lines. More particularly, the apparatus of the invention comprises a coiled spring assembly that is controllably fed through the waist line. The coil spring assembly uniquely includes an elongated flexible tube, or sheath, defining an internal passageway and an elongated helically wound spring wire wound about the elongated flexible tube. Affixed to the outboard of the coiled spring assembly is a small video camera and a plurality of cutter blades for cutting away blockage in the waste lines. Disposed within the internal passageway of the elongated flexible tube is a fiber optic signal transmitting cable as well as various other operating cables that interconnect the video camera with a power source and with a remote viewing monitor. Also disposed within the internal passageway of the elongated flexible tube is a novel steel pull cable that uniquely functions protect the fiber optic signal transmitting cable and its companion operating cables from undue stress and potential failure during the waste line clean-out operation.

2. Discussion of the Prior Art

A wide variety of waste line clean-out devices have been suggested in the past. Normally the prior art waste line clean-out devices embody an elongated clean-out member known as a plumbers' snake. The plumbers' snake is ordinarily housed within a drum or hollow housing having an opening through which the spring or snake is fed and retracted axially of itself as the container is rotated. For those tools having power operated spring advancing and retracting means, the feed mechanism for advancing the coiled spring typically includes jaws, rollers, segmented nuts, or like structures that grip the spring so that when the spring is fed through the feed while being rotated it is controllably advanced into or retracted from the sewerline. As a general rule, cutter means affixed to the free end of the plumbers' snake function to cut away and clear blockages formed in the sewerline.

A very successful prior art waste clean-out apparatus is described in U.S. Pat. No. 5,193,242 issued to the present inventor. This patent concerns an apparatus similar in some respects to the apparatus described in the present application, but does not contemplate means for visually inspecting the interior of the waste line as the cutting means cuts through an obstruction formed in the water lines. U.S. Pat. No. 5,193,242 is incorporated by reference as though fully set forth herein.

Another very successful prior art waste clean-out apparatus is described in U.S. Pat. No. 5,862,561 also issued to the present inventor. This latter patent discloses an apparatus for removing and cleaning away obstructions formed in and blocking waste lines. The apparatus disclosed in U.S. Pat. No. 5,862,561 includes a unique high pressure jet water spray head which cooperates with a cutting element to remove obstructions in the waste line as the coil spring is urged forwardly of the waste line. The apparatus also includes a small video camera which is interconnected with a viewing monitor carried by the frame of the apparatus. Because of its pertinence to the present invention, U.S. Pat. No. 5,193,242 is hereby incorporated by reference as though fully set forth herein. A drawback of the apparatus of U.S. Pat. No. 5,193,242 resides in the fact that during the waste line clean-out operation the various companion operating cables of the apparatus that interconnect the video camera with the viewing monitor are susceptible to undesirable overstressing and possible catastrophic failure. It is this drawback that the present invention seeks to overcome. As will be appreciated from the discussion that follows, the apparatus of the present invention constitutes a substantial improvement over the apparatus of U.S. Pat. No. 5,193,242 in that it provides novel means for positively preventing overstressing and possible catastrophic failure of the fiber optic signal transmitting cable and the various companion operating cables of the apparatus that interconnect the video camera with the viewing monitor.

In addition to the waste line clean-out devices discussed in the preceding paragraphs, various somewhat similar devices have been suggested for inspecting the interior walls of the sewerline. One such device is disclosed in U.S. Pat. No. 5,457,288 issued to Olsen. This apparatus uses electro-mechanical systems for inspecting the inside of pipes for defects and obstructions and more particularly discloses a push cable that mechanically and electrically connects a video camera head to a push reel and video circuit. The push cable of the device comprises an elongated, resiliently flexible push member and an elongated signal transmitting cable. In use, the video camera which is disposed proximate the free end of the push cable, permits visual inspection of the walls of the pipe as the push cable is pushed along the length of the pipe. However, these devices are limited to use with short drain lines, whereas the device of the present invention, which uses automatic feed and turn power for rotating the cable drum can be used in much longer drain lines.

SUMMARY OF THE INVENTION

It is an object of the present invention to provide an improved power driven machine of the type that overcomes the drawbacks of the prior art push cable video devices by providing a coiled spring assembly that can be controllably withdrawn from the machine by an automatic feed for insertion into the pipe to be cleaned. The coiled spring assembly comprises an elongated flexible coil spring formed of helically wound spring wire that is coiled about an elongated substantially waterproof flexible sheath that defines an interior passageway. The power driven machine includes a one piece rotatable storage drum that is carried by the machine frame and within which a portion of the coil spring can be conveniently housed. A forward guide portion is provided to pressurally engage the spring during operation of the machine and closely guide its withdrawal from an insertion into the storage drum.

A particular object of the present invention is to provide a waste line clean-out apparatus of the aforementioned character in which a video camera is positioned proximate the outboard end of the elongated flexible coil spring assembly and is interconnected with a remotely located viewing monitor.

Another object of the invention is to provide an apparatus of the character described in the preceding paragraph which includes novel means for protecting the fiber optic signal transmitting cable and the various companion operating cables which interconnect the video camera with the viewing monitor from overstressing and catastrophic failure during the waste line clean-out operation. More particularly, the apparatus of the present invention includes a uniquely configured steel pull cable of a strategic length that is carried within the internal passageway of the flexible sheath of the coil spring assembly and is connected at one end to the machine frame and is connected at its opposite end to a camera housing that houses the video camera. During the waste line clean-out operation, the steel pull cable effectively prevents overstressing of the fiber optic signal transmitting cable and its companion operating cables as a result of severe flexing of the coil spring assembly.

Another object of the invention is to apply an automatic feeding mechanism to urge the cable forward or reverse when under operation.

Another object of the invention is to provide a novel waste line inspection and clean-out apparatus which includes connector means for connecting the video camera as well as cutter blades for clearing away the particular clogged sewer-line at hand to the coiled spring assembly.

Another object of the invention is to provide a novel waste line inspection and clean-out apparatus which embodies a unique automatic feed for advancing the clean-out snake into the waste line to be cleaned.

Another object of the invention is to provide a novel waste line inspection and clean-out apparatus of the class described which is of a simple construction and is highly reliable in operation.

DESCRIPTION OF ONE FORM OF THE INVENTION

Figure 1:
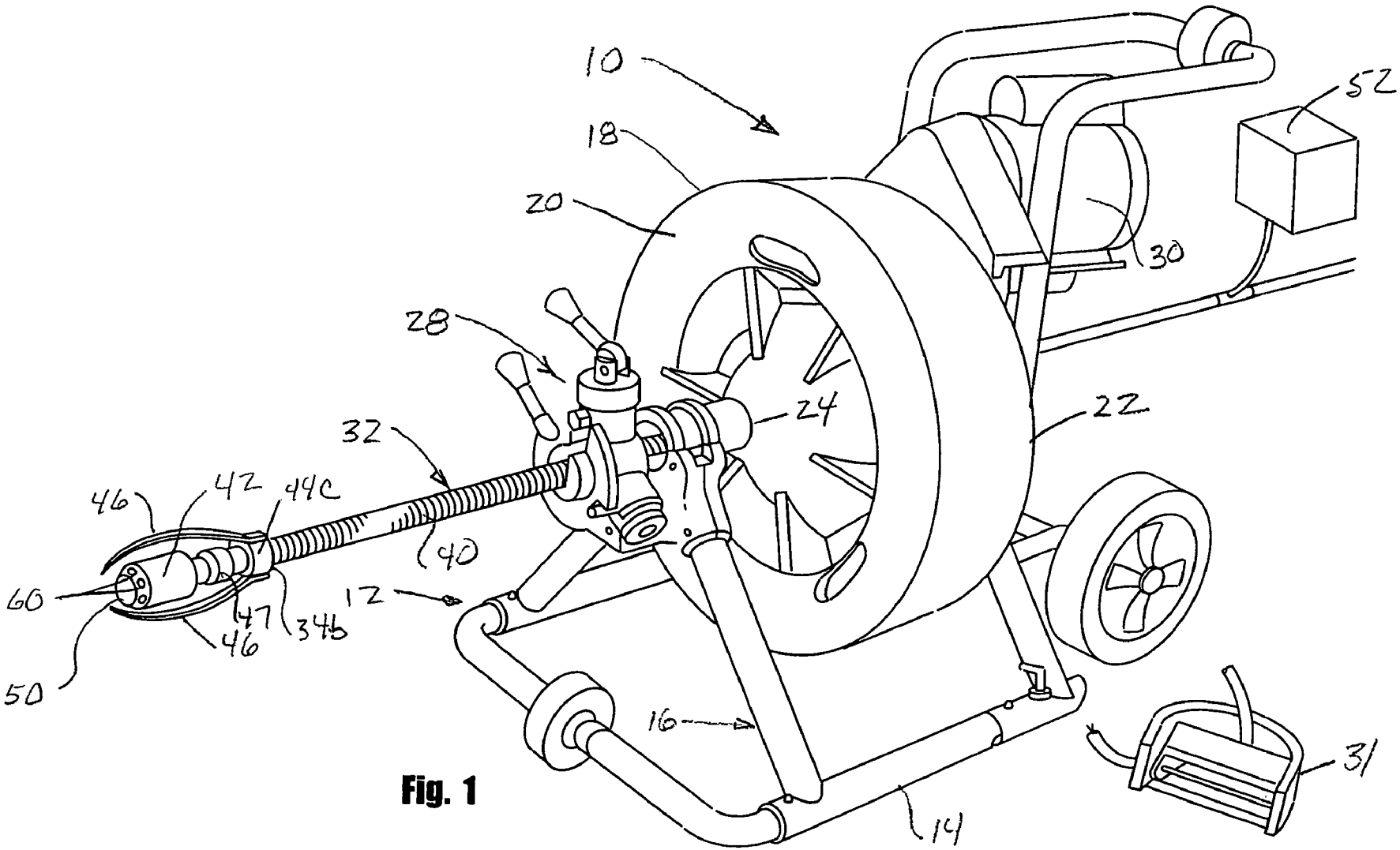
FIG. 1 is a generally perspective view of one form of the combination waste line inspection clean-out tool of the present invention.
Figure 2:
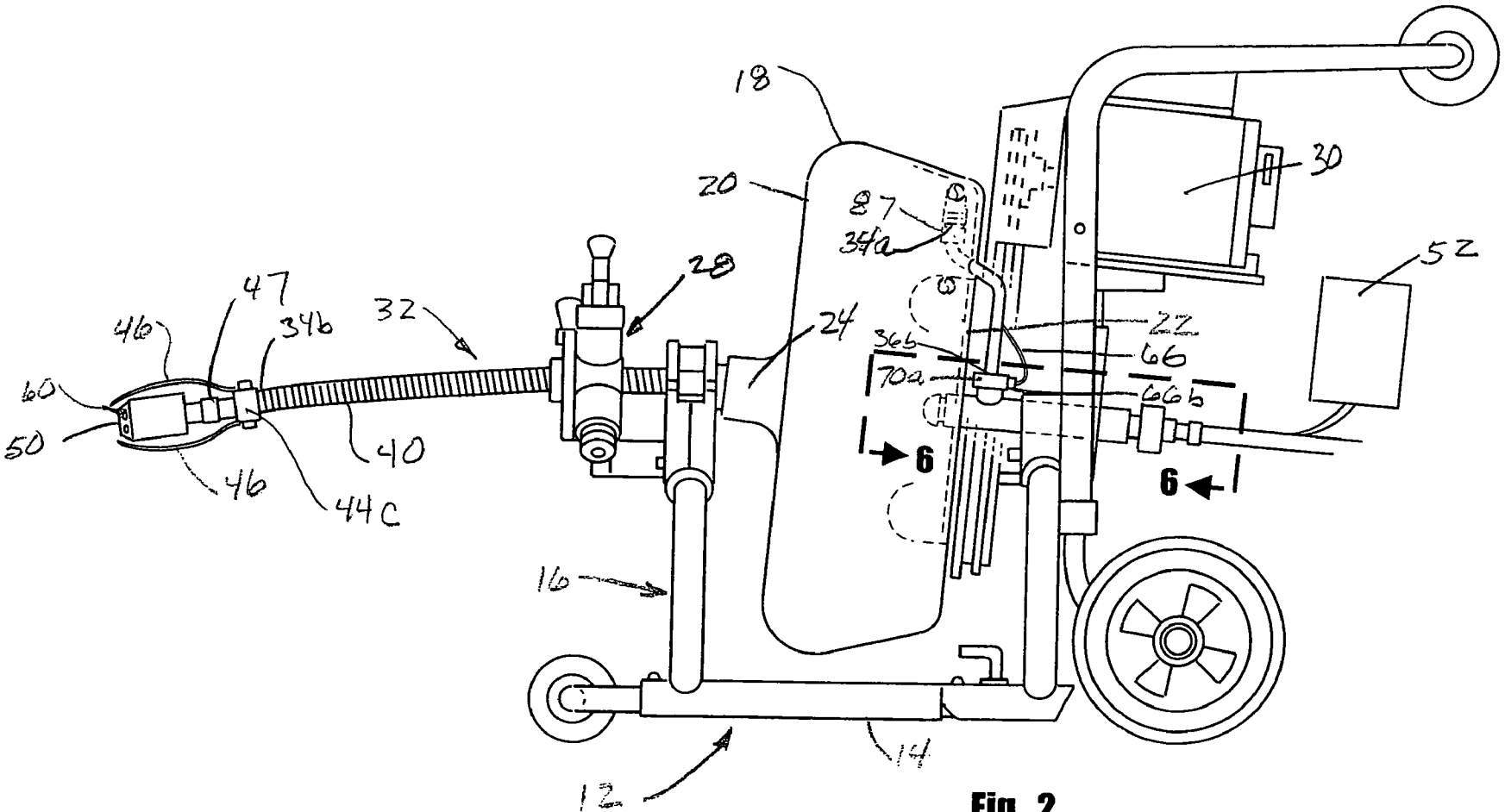
FIG. 2 is a side-elevational view of the apparatus shown in FIG. 1.

Referring to the drawings and particularly to FIGS. 1 and 2, one form of the combination waste line inspection and clean-out tool of the present invention is there shown and generally identified by the numeral 10. The apparatus here comprises a supporting frame 12 having a base portion 14 and an upstanding, portion 16. Rotatably connected to upstanding portion 16 is a coil spring housing 18 that houses portions of the coiled spring, or plumbers' snake. Housing 18 is of the general character illustrated and described in the incorporated by reference U.S. Pat. No. 5,193,242 and includes a generally annular shaped body portion 20 having a rear wall 22 (FIG. 2) and a generally frusto-conically shaped forward guide portion 24.

A feed means, generally designated by the numeral 28, is connected to frame 12 and functions to engage the forward portion of the novel coil spring assembly of the invention in a manner to controllably withdraw the coil spring assembly from spring housing 18 and cause it to travel forwardly and reversely of the apparatus through the forward guide portion 24 of spring housing 18. The feed means of the present invention is identical to that described in incorporated by reference U.S. Pat. No. 5,193,242 and reference should be made to that patent for a detailed description of the construction and operation of this novel feed means. Similarly, the supporting frame 12 is of a construction generally similar to that shown in U.S. Pat. No. 5,193,242 and reference should be made to the patent for a more detailed discussion of the construction and assembly of the main supporting frame 12. A drive means comprising an electric motor 30 is carried by the upstanding portion 16 of frame 12 and can be energized by a foot switch 31 (FIG. 1) to controllably rotate spring housing 18 about the central axis thereof. Once again this drive means is of a generally similar construction to that described in U.S. Pat. No. 5,193,242.

Forming an extremely important aspect of the present invention is the novel coil spring assembly, which here includes an elongated, helically wound spring wire or plumbers' snake 32. During operation of the tool, snake 32 is forced down the waste line "W" (FIG. 3) so as to encounter and break up obstructions that have been formed internally of the waste line. The coil spring assembly 34 has a rearward portion 34*a* which is disposed within the body portion 20 of spring housing 18 (FIG. 2) and a forward portion 34*b* which extends through the forward guide portion 24 of the spring housing and into the feed means 28.

Figure 3:
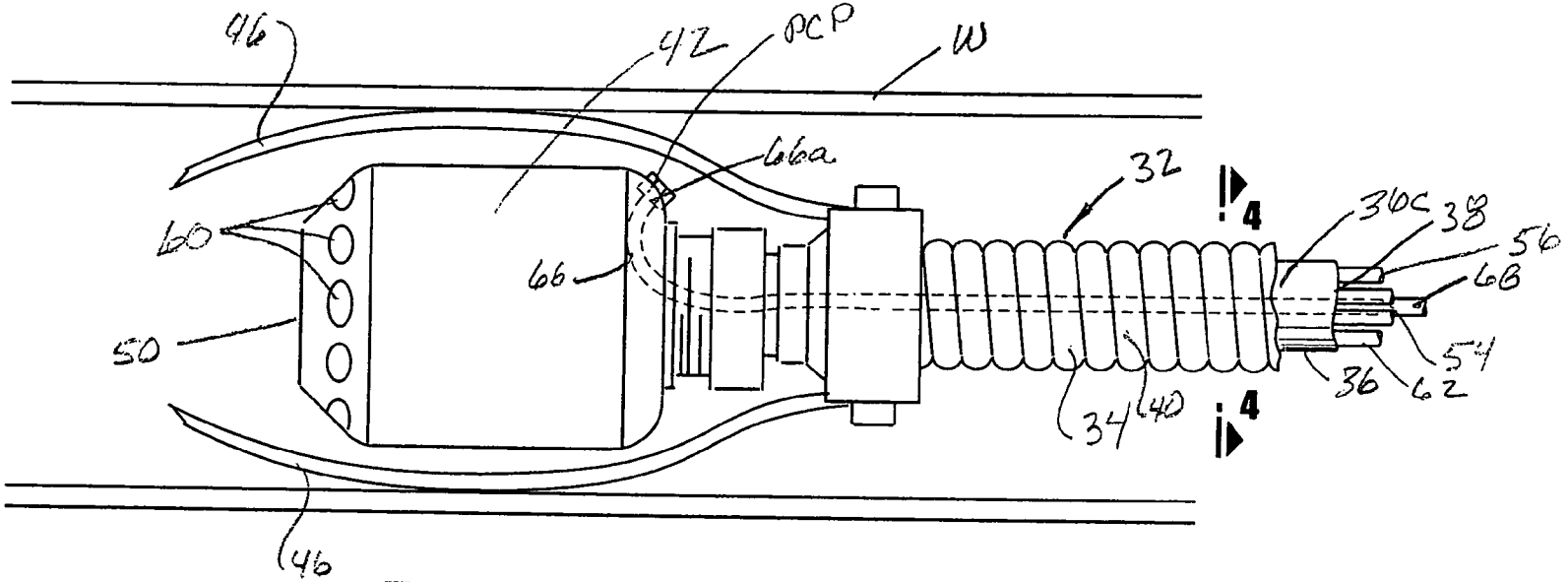
FIG. 3 is a greatly enlarged view of the clean-out head and video camera assembly of the invention as it appears when inserted into the waste line to be cleaned.
Figure 4:
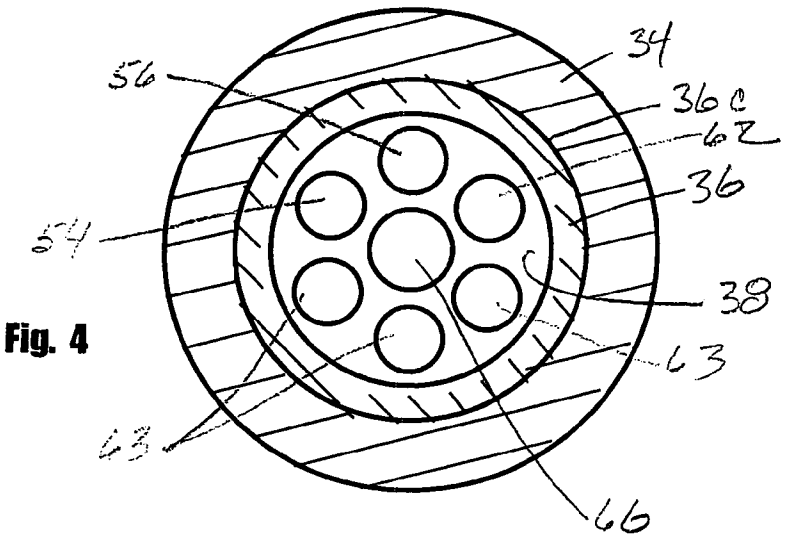
FIG. 4 is a greatly enlarged, cross-sectional view taken along lines 4-4 of FIG. 3.
Figure 5:
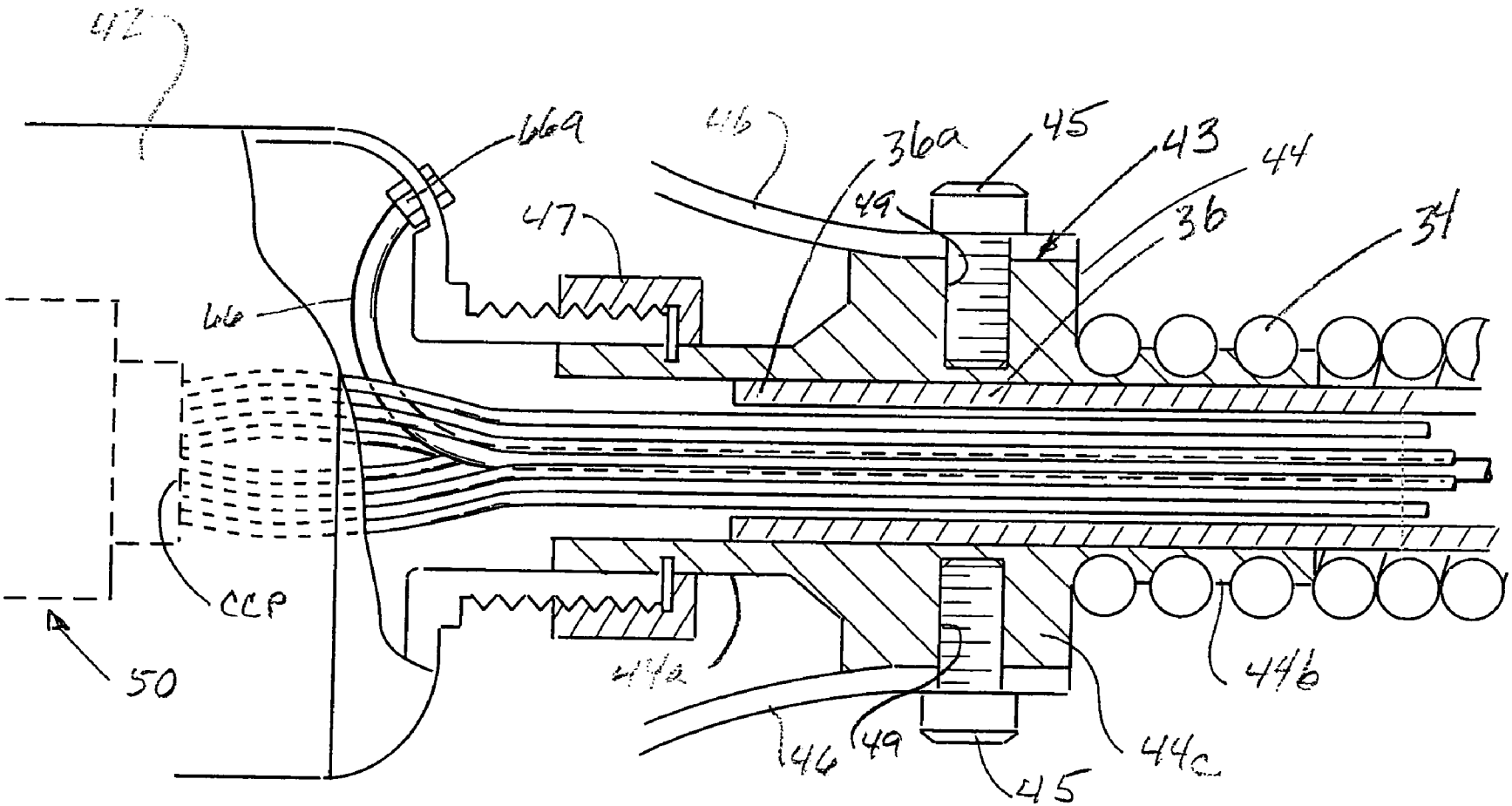
FIG. 5 is a cross-sectional view similar to FIG. 3 but showing the internal construction of the coil spring assembly and the manner in which the operating cables and pull wire of the apparatus are interconnected with the camera assembly.

As shown in FIGS. 3, 4 and 5, coil spring assembly 34 includes an elongated, flexible elastomeric tube, or sheath 36, which is of a first length and has an internal passageway 38. Tube 36 has a forward extremity 36*a* (FIG. 5) and a rearward extremity 36*b*, which is received within body portion 20 (FIG. 2). Helically wound about flexible sheath 36 is an elongated spring wire 40 which closely circumscribes the external surface 36*c* of flexible sheath (FIG. 4). Spring wire 40 and the manner of helically coiling the wire about flexible sheath 36 is well understood by those skilled in the art.

As shown in FIG. 5, flexible sheath 36 communicates at its forward end 36*a* with the interior of a camera housing 42 via a connector assembly 43 within which it is telescopically received. As indicated in FIG. 5, coil spring assembly 34 is connected to a generally tubular-shaped connector member 44, which comprises a part of connector assembly 43. As seen in FIG. 5, connector member 44 has first and second portions 44*a* and 44*b* and a central portion 44*c*. A plurality of outwardly extending curved cutter blades 46 are connected to central portion 44*c* of the connector member by threaded connectors 45, while camera housing 42 is connected to the second portion 44*b* of the connector member by means of an internally threaded split ring 47.

Cutter blades 46 comprise a part of the novel cutter means of the invention for cutting into and removing obstructions such as clogs formed in the waste line "W" being cleaned. To removably interconnect the cutter blades 46 with connector member 44, portion 44*a* of the connector member is provided with circumferentially spaced, threaded bores 49 that receive threaded connectors 45. Connectors 45 function to removably interconnect blades 46 with connector member 44 in the manner shown in FIG. 5.

Disposed within camera housing 42, which forms a part of the camera means of the invention, is a video camera assembly 50. Camera assembly 50 is readily commercially available from several sources including Screco Flexible of Lima, Ohio. A suitable camera for the present application is sold by Screco Flexible as Part No BV-101. However, it is to be understood that other types of video cameras can also be used with the apparatus shown in the drawings.

With the waste line clean-out apparatus in the assembled configuration shown in FIG. 2, cleaning of the clogged waste line "W" can be accomplished by first inserting the cutter means along with the outboard end of the coil spring assembly into the waste line to be cleaned in the manner shown in FIG. 3. This done, using foot switch 31, motor 30 is energized to cause rotation of spring housing 18 and, in the manner discussed in U.S. Pat. No. 5,193,242, rotation of the coil spring assembly housed there within. Operation of the feed means 28 will then cause the coil spring to be controllably withdrawn from the spring housing and advanced through the waste line to be cleaned via guide portion 24 and feed means 28.

Upon the cutter means engaging the obstruction within the waste line, the cutter blades will efficiently cut away the obstruction so that it can be easily removed from the waste line.

Considering now the transfer means of the invention for interconnecting the camera means with the viewing means, or remote monitor 52. This important means here includes a plurality of operating cables of the character shown in FIG. 4. More particularly, the operating cables here comprise a fiber optic signal transmitting cable 54 having a second length, a power cable 56 for supplying electrical power to the camera, a power cable 58 for supplying electrical power to a plurality of lights 60 mounted on camera housing 42, a ground wire 62 and various other connector cables 63 of a character well known to those skilled in the art. The details of the interconnection of the various cables with the camera, with the viewing monitor and with power and ground are well understood by those skilled in the art and need not be here discussed.

In addition to the operating cables, the important pull wire 66 of the invention, is also carried within the internal passageway 38 of sheath 36. As previously discussed, pull wire 66, which functions to protect the fiber optic signal transmitting cable and the various companion operating cables that interconnect the video camera with the viewing monitor, from overstressing and catastrophic failure during the waste line clean-out operation.

Figures 6, 7:
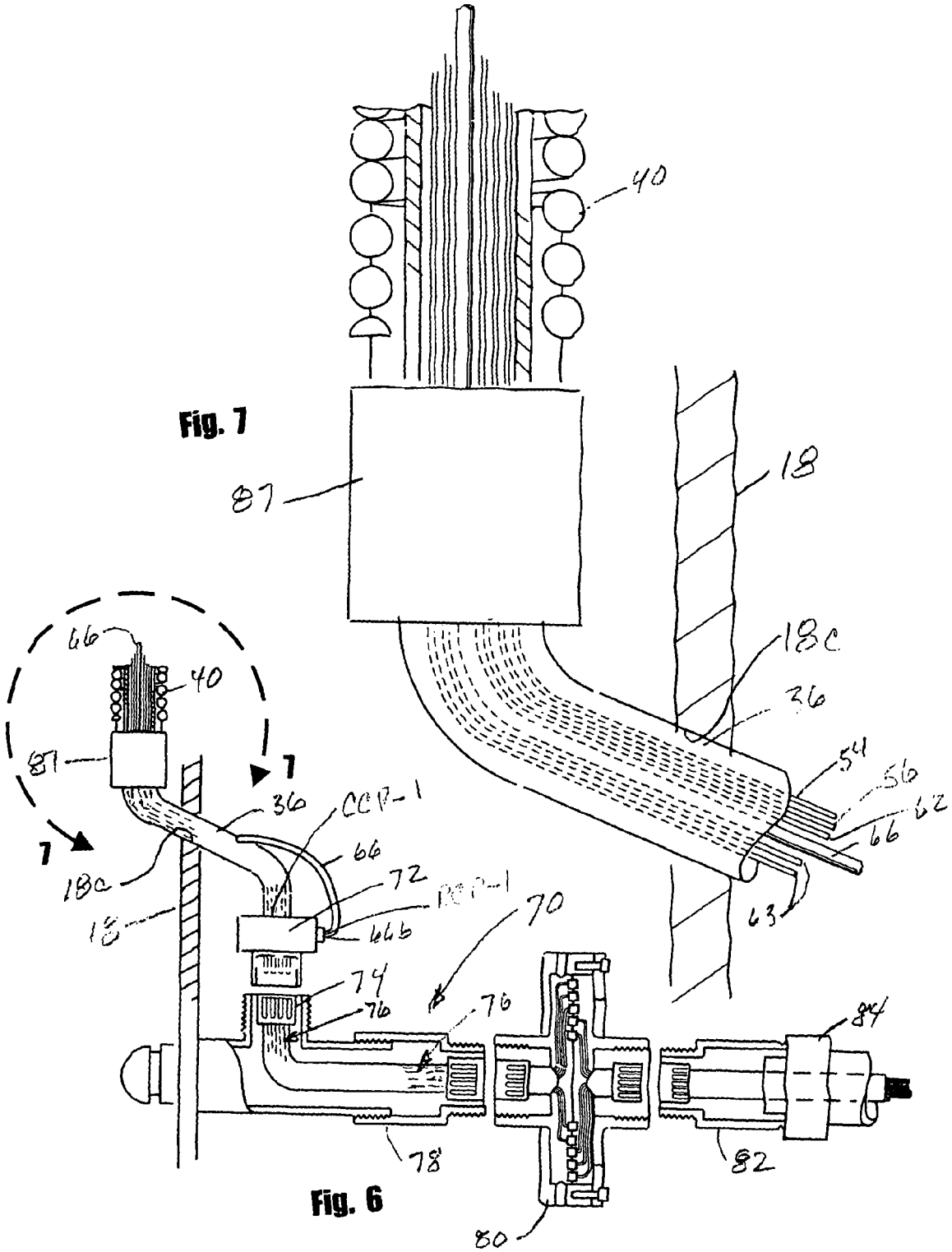
FIG. 6 is a greatly enlarged, cross-sectional view taken along lines 6-6 of FIG. 2.
FIG. 7 is a greatly enlarged, cross-sectional view of the area designated in FIG. 6 as "7".

As best seen in FIGS. 2, 3, 4 and 6 of the drawings, pull cable 66, which is entrained through sheath 36, has first-end 66*a* that is connected to the camera housing 42 and a second end 66*b* that is connected to a non-rotating component, in this case the male connector 70*a* of a connector assembly 70. As indicated in FIG. 6, connector assembly 70 interconnects the fiber optic signal transmitting cable and the various companion operating cables with a male connector 72 that is interconnected with a female connector 74. Female connector 74 is, in turn, connected to a plurality of monitor cables 76 that interconnect the fiber optic signal transmitting cable and the various companion operating cables with the monitor 52 via a first adapter 78, a swivel connector 80 a second adapter 82, a monitor connector 84. During operation of the apparatus of the invention, as the spring housing 18 rotates, the rotating components of the invention, namely the connectors 72 and 74 and the first adapter 78, also rotate, while, because of the swivel connector 80, the second adapter 82 remains stationary. As best seen in FIGS. 6 and 7, the coil spring 40 is coupled with the sheath 36 by a connector 87 so that the sheath continues on and extends through an opening 18*c* formed in drum 18. The sheath, along with the various connectors that are housed there within, then extends onward toward and is connected with connector 72 in the manner shown in the drawings.

Connector assembly 70, connectors 72 and 74, first adapter 78, swivel connector 80, second adapter 82 and monitor connector 84, which all form a part of the transfer means of the invention, are of a character well understood by those skilled in the art and are readily commercially available. For example, connectors 72 and 74, first adapter 78, second adapter 82 and monitor connector 84 can be purchased from the Connect DSC Company of Boston Mass. Swivel connector 80, which also forms a part of the transfer means of the invention, can be of various constructions well understood by those skilled in the art and, in one form of the invention, can comprise cooperating swivel plates of the character described in incorporated by reference U.S. Pat. No. 5,862,561. Reference should be made to this patent for a discussion of the construction and operation of the swivel plates.

In the present embodiment of the invention the optic signal transmitting cable 54 is of a second length greater than the first length of the coil spring assembly so as to allow for changes in overall length of the coil spring assembly due to flexing of the assembly during the cleanout operations. More particularly, the slack provided in the operating cables accommodates to some extent to the changes in length of the coil spring assembly. However, to positively prevent stresses from being imposed on the optic signal transmitting cable 54, as well as the other the various companion operating cables during the cleanout operations, the elongated pull cable 66 of the invention is strategically sized so as to have a third length that is less than the second length of the optic signal transmitting cable by about ¾ of an inch. With this novel construction, the pull wire 66 will positively prevent any stress from being imposed on the optic signal transmitting cable 54, as well as the other the various companion operating cables, due to the lengthening of the coil spring assembly during the cleanout operation that can over stress the cables to the point of failure.

With the apparatus of the invention as described in the preceding paragraphs, after the waste line blockage has been removed, camera assembly 50 can be used to inspect the interior of the waste line for damage and can be used to verify complete removal of the blockage. Camera assembly 50 can also be used to visually locate branch lines and to verify the integrity of the waste line along its length.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made with out departing from the scope and spirit of the invention, as set forth in the following claims.

I claim:

1. A waste line clean-out tool comprising:

(a) a supporting frame;

(b) a spring housing rotatably mounted on said supporting frame;

(c) a coiled spring assembly having a rearward portion disposed within said spring housing and a forward portion extending outwardly of said spring housing, said coiled spring assembly comprising:

(i) an elongated flexible tube defining an internal passageway; and (ii) an elongated helically wound spring wire wound about said elongated flexible tube;

(d) a generally tubular-shaped connector member connected to said coiled spring assembly, said connector member having a first portion and a second portion;

(e) a plurality of cutter blades connected to said first portion of said connector member;

(f) camera means connected to said second portion of said connector member for providing images of the interior of the waste line;

(g) viewing means connected to said frame for viewing said images provided by said camera means;

(h) transfer means carried within said internal passageway of said elongated flexible tube for interconnecting said camera means with said viewing means, said transfer means including a non-rotating component and a plurality of operating cables disposed within said internal passageway of said elongated flexible tube for operating said camera, said operating cables having a length;

(i) an elongated pull cable carried within said internal passageway of said elongated flexible tube, said elongated pull cable having a length less than said length of said coiled spring assembly and having a first-end connected to said camera means and a second end connected to said non-rotating component of said transfer means; and (j) feed means connected to said frame for removable engagement with said forward portion of said coiled spring assembly to controllably withdraw a portion of said coiled spring assembly from said spring housing.

2. The tool defined in claim 1, further including drive means connected to said frame for rotating said spring housing about the central axis thereof.

3. The tool as defined in claim 1 in which said elongated pull cable comprises a length of steel cable having a length approximately three quarters of an inch less than said length of said operating cables.

4. The tool as defined in claim 1 in which said camera means comprises:

(a) a camera housing;

(b) a plurality of lights connected to said camera housing; and (c) a video camera housed within said camera housing.

5. The tool as defined in claim 4 in which said plurality of operating cables disposed within said internal passageway of said elongated flexible tube include a fiber optic signal transmitting cable, a power cable for supplying electrical power to said camera, a power cable for supplying electrical power to said plurality of lights and a ground wire.

6. A waste line clean-out tool comprising:

(a) a supporting frame;

(b) a spring housing rotatably mounted on said supporting frame;

(c) a coiled spring assembly having a rearward portion disposed within said spring housing and a forward portion extending outwardly of said spring housing, said coiled spring assembly comprising:

(i) an elongated flexible tube defining an internal passageway; and (ii) an elongated helically wound spring wire wound about said elongated flexible tube, said spring wire having a first length;

(d) a generally tubular-shaped connector member connected to said coiled spring assembly, said connector member having a first portion and a second portion;

(e) a plurality of cutter blades connected to said first portion of said connector member;

(f) camera means connected to said second portion of said connector member for providing images of the interior of the waste line;

(g) viewing means connected to said frame for viewing said images provided by said camera means;

(h) transfer means carried within said internal passageway of said elongated flexible tube for interconnecting said camera means with said viewing means, said transfer means including a non-rotating component and plurality of operating cables disposed within said internal passageway of said elongated flexible tube for operating said camera, said operating cables including a fiber optic signal transmitting cable having a second length greater than said first length;

(i) an elongated pull cable carried within said internal passageway of said elongated flexible tube, said elongated pull cable having a first end connected to said camera means and a second end connected to said non-rotating component of said transfer means, said elongated pull cable having a third length greater than said first length and less than said second length;

(j) feed means connected to said frame for removable engagement with said forward portion of said coiled spring assembly to controllably withdraw a portion of said coiled spring assembly from said spring housing; and (k) drive means connected to said frame for rotating said spring housing about the central axis thereof.

7. The tool as defined in claim 6 in which said elongated pull cable comprises a length of steel cable.

8. The tool as defined in claim 6 in which said camera means comprises:

(a) a camera housing;

(b) a plurality of lights connected to said camera housing; and (c) a video camera housed within said camera housing.

9. The tool as defined in claim 8 in which said plurality of operating cables disposed within said an internal passageway of said elongated flexible tube further include a power cable for supplying electrical power to said camera, a power cable for supplying electrical power to said plurality of lights and a ground wire.

10. A waste line clean-out tool comprising:

(a) a supporting frame;

(b) a spring housing rotatably mounted on said supporting frame;

(c) a coiled spring assembly having a rearward portion disposed within said spring housing and a forward portion extending outwardly of said spring housing, said coiled spring assembly comprising:

(i) an elongated, flexible tube defining an internal passageway; and (ii) an elongated, helically wound spring wire wound about said elongated, flexible tube, said spring wire having a first length;

(d) a generally tubular-shaped connector member connected to said coiled spring assembly, said connector member having a first portion and a second portion;

(e) a plurality of cutter blades connected to said first portion of said connector member;

(f) camera means connected to said second portion of said connector member for providing images of the interior of the waste line, said camera means comprising:

(i) a camera housing; and (ii) a video camera housed within said camera housing;

(g) viewing means connected to said frame for viewing said images provided by said camera means;

(h) transfer means carried within said internal passageway of said elongated flexible tube for interconnecting said camera means with said viewing means, said transfer means including a non-rotating component and a plurality of operating cables disposed within said internal passageway of said elongated flexible tube for operating said camera, said operating cables having a second length greater than said first length and comprising a fiber optic signal transmitting cable;

(i) an elongated steel pull cable carried within said internal passageway of said elongated flexible tube, said elongated steel pull cable having a first end connected to said camera means and a second end connected to said non-rotating component of said transfer means, said elongated pull cable having a third length greater than said first length and less than said second length;

(j) feed means connected to said frame for removable engagement with said forward portion of said coiled spring assembly to controllably withdraw a portion of said coiled spring assembly from said spring housing; and (k) drive means connected to said frame for rotating said spring housing about the central axis thereof.

11. The tool as defined in claim 10 in which said camera means further comprises a plurality of lights connected to said camera housing.

12. The tool as defined in claim 11 in which said plurality of operating cables disposed within said an internal passageway of said elongated flexible tube further include a power cable for supplying electrical power to said camera, a power cable for supplying electrical power to said plurality of lights and a ground wire.

* * * * *